US010712121B2

(12) United States Patent
Moran et al.

(10) Patent No.: US 10,712,121 B2
(45) Date of Patent: Jul. 14, 2020

(54) PERSONAL DEFENSE TOOLS

(71) Applicants: Timothy E. Moran, Long Island, NY (US); Harry J. Tolley, Brooklyn, NY (US)

(72) Inventors: Timothy E. Moran, Long Island, NY (US); Harry J. Tolley, Brooklyn, NY (US)

( * ) Notice: Subject to any disclaimer, the term of this patent is extended or adjusted under 35 U.S.C. 154(b) by 0 days.

(21) Appl. No.: 16/024,674

(22) Filed: Jun. 29, 2018

(65) Prior Publication Data

US 2019/0011218 A1 Jan. 10, 2019

Related U.S. Application Data

(60) Provisional application No. 62/526,661, filed on Jun. 29, 2017.

(51) Int. Cl.

| | |
|---|---|
| ***F41B 15/00*** | (2006.01) |
| ***F41A 35/00*** | (2006.01) |
| ***F41A 33/02*** | (2006.01) |
| ***F41B 15/02*** | (2006.01) |

(52) U.S. Cl.

CPC ..... *F41B 15/00* (2013.01); *F41A 33/02* (2013.01); *F41A 35/00* (2013.01); *F41B 15/02* (2013.01)

(58) Field of Classification Search

CPC ..... F41B 15/00–027

USPC ..... 362/102, 110–114

See application file for complete search history.

(56) References Cited

U.S. PATENT DOCUMENTS

| | | | | |
|---|---|---|---|---|
| 5,595,165 A * | 1/1997 | Conte | ..... | A63H 5/04 124/18 |
| 5,795,054 A * | 8/1998 | Booty, Jr. | ..... | F41H 9/10 222/162 |
| 2011/0194300 A1* | 8/2011 | Olsen | ..... | F41B 15/022 362/471 |

* cited by examiner

*Primary Examiner* — Sean P Gramling

(74) *Attorney, Agent, or Firm* — JWIP & Patent Services, LLC; Jacob G. Weintraub, Esq.

(57) ABSTRACT

The present invention is directed to novel non-propellant personal defense tools that provide increased safety to users that prefer non-lethal weapons. In particular, the novel non-propellant personal defense tools of the present invention comprise a combat housing in an innovative combination with a vision impairment light, and sliding forend that creates sound when bidirectionally engaged, for example, as in the cocking of a shotgun. A non-propellant personal defense tool of the present invention is a hefty deterrent and resembles the image and action of a shotgun by an attacker when the vision of the attacker is impaired by the vision impairment light. In specific embodiments, the combat housing is shaped like a bat. Additionally, further embodiments also trigger an alarm or an alarm system.

24 Claims, 9 Drawing Sheets

PERSONAL DEFENSE TOOLS

RELATED APPLICATIONS

This application claims priority to U.S. Provisional Patent Application No. 62/526,661 filed on Jun. 29, 2017; the entirety of which is incorporated herein by reference.

BACKGROUND OF THE INVENTION

Personal defense tools, especially those that consumers utilize for home defense, may be classified in two very broad categories: propellant based and non-propellant based personal defense tools. The propellant based tools include weapons, such as handguns, rifles, and shotguns, which use propellants to launch projectiles toward an attacker. Such projectiles are considered lethal, and as such, the propellant based weapons are also considered to be lethal weapons. And in most cases, such weapons require special training and licensure by the state/federal government.

Alternatively, non-propellant based personal defense tools include weapons such as pepper sprays, knives, batons, and electroshock weapons like stun guns. Small, portable, and legal in most states without a license, these home defense weapons can be kept in the bedroom in a nightstand or carried with you in case of an emergency. Unfortunately, although many people prefer the non-lethal personal defense tools given the supposed risks of using and storing propellant based weapons, there is clearly a difference on the effect each these types has on an attacker.

The general belief is that what makes you feel safest is the right solution. However, a more accurate statement is that what provides you the greatest safety in the face of an attacker, within your risk tolerance, is the right solution. User peace of mind during an attack is only one component of the safety aspect of the weapon; the other more important component, however, is the mental effect on the attacker. And in this way, known non-propellant based weapons, which are non-lethal, have greater difficultly in achieving the desired personal defense than do propellant based weapons, i.e., given the attacker's perception of the potential harm that my befall them.

As such, there is a need for new non-propellant personal defense tools that address these concerns, providing increased safety to users that prefer non-lethal weapons.

SUMMARY OF THE INVENTION

Accordingly, the present invention is directed to novel non-propellant personal defense tools that provide increased safety to users that prefer non-lethal weapons. In particular, the novel non-propellant personal defense tools of the present invention comprise a combat housing in an innovative combination with a vision impairment light, and sliding forend that creates sound when bidirectionally engaged, for example, as in the cocking of a shotgun. A non-propellant personal defense tool of the present invention is a hefty deterrent and resembles the image and action of a shotgun by an attacker when the vision of the attacker is impaired by the vision impairment light. In specific embodiments, the combat housing is shaped like a bat. Additionally, further embodiments also trigger an alarm or an alarm system.

As such, one aspect of the invention provides a non-propellant personal defense tool (PDT) comprising a combat housing acting as a scaffold for a sliding sound assembly comprising a sliding forend operationally associated with said combat housing to bidirectionally slide over a defined segment of the combat housing. The act of sliding the forend in each direction along the sliding segment creates a defined sound. The combat housing also acts as a scaffold for a battery assembly comprising a battery and a vision impairment light operationally associated with the battery. In certain embodiments, the combat housing is a substantially cylindrical combat housing, for example, an aluminum baseball bat housing. In certain embodiments, the defined sound is the cocking sound of a forend of a rifle, e.g., shotgun, e.g., a "tchk-tchk" of a cocking shotgun. In certain embodiments, the vision impairment light is positioned in the top end cover of the combat housing, for example, wherein the vision impairment light is greater than or equal to 80 lumens; and further comprises a button, e.g., located on the handle, that is capable of activating the light, e.g., when depressed.

BRIEF DESCRIPTION OF THE FIGURES

Advantages of the present apparatus will be apparent from the following detailed description, which description should be considered in combination with the accompanying figures, which are not intended to limit the scope of the invention in any way.

DETAILED DESCRIPTION OF THE INVENTION

Figure 1:
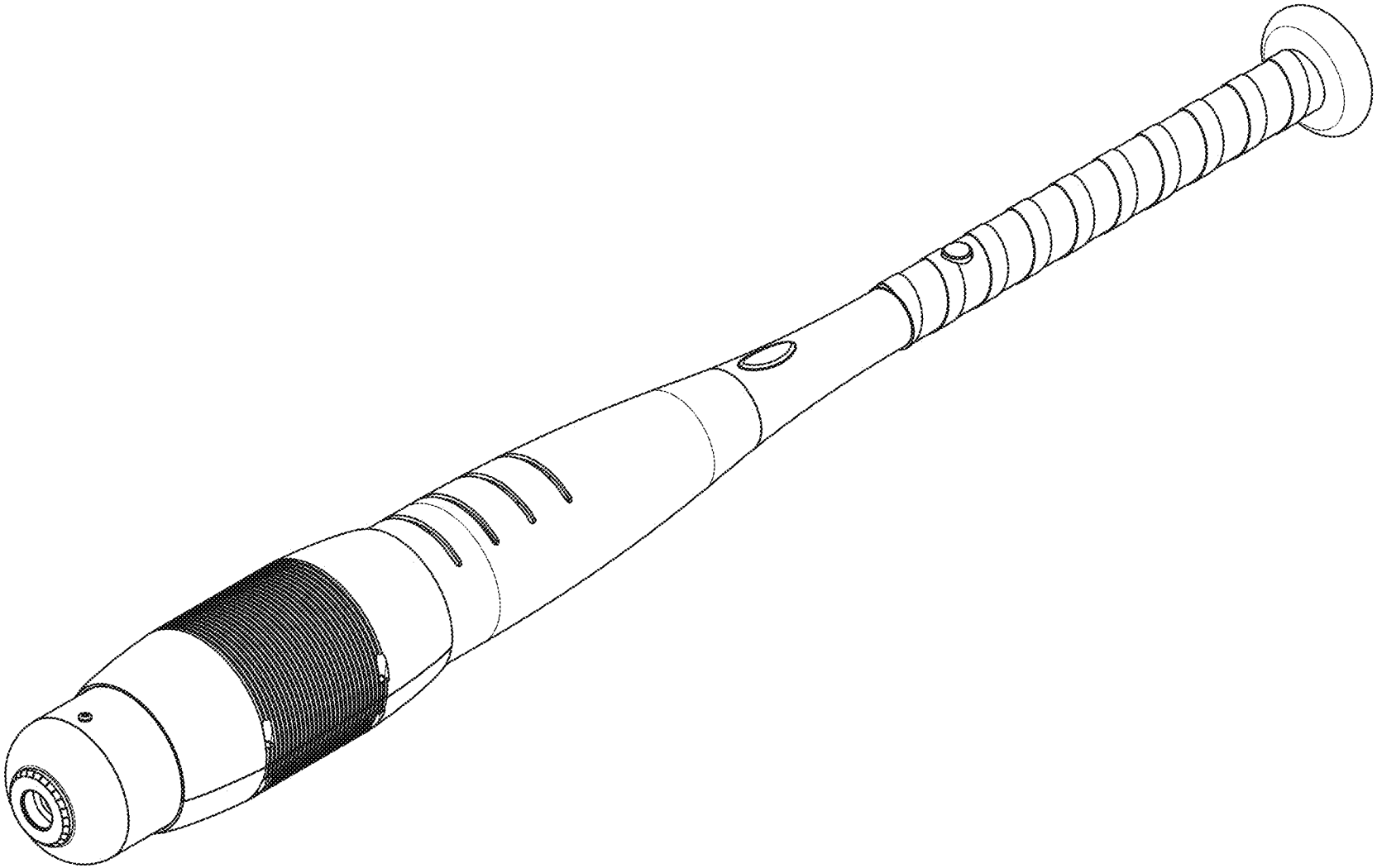
FIG. 1 is a side perspective view of a non-propellant personal defense tool (PDT) of certain embodiments of the present invention wherein the combat housing is an aluminum bat with additional components designed to fit inside the body, including LED flashlight that fits in the front end and is activated by pressing button located on the handle, and a panic button system located on the neck of the bat.

There is a growing segment of the population that desires to protect themselves and their loved ones with a weapon, but however, have reservations about using lethal weapons. In this way, although non-lethal personal defense tools provide some level of increased safety to users that prefer non-lethal weapons, such weapons fail to instill the same level of fear in an attacker provided by lethal weapons. Accordingly, the personal defense tools of the present invention offer a hefty deterrent, comprising non-lethal combat housings capable of causing non-lethal injury, while also having the added benefit of increased safety by affording the perception of a lethal injury to an attacker faced with the personal defense tools of the present invention.

In this way, the present invention is directed to novel non-propellant personal defense tools that provide increased safety to users that prefer non-lethal weapons. In particular, the novel non-propellant personal defense tools of the present invention comprise a combat housing in an innovative combination with a vision impairment light, and sliding forend that creates sound when bidirectionally engaged, for example, as in the cocking of a shotgun. A non-propellant personal defense tool of the present invention is a hefty deterrent and resembles the image and action of a shotgun by an attacker when the vision of the attacker is impaired by the vision impairment light. In specific embodiments, the combat housing is shaped like a bat. Additionally, further embodiments also trigger an alarm or an alarm system.

The present invention, including non-propellant personal defense tools, kits, and methods will be described with reference to the following definitions that, for convenience, are set forth below. Unless otherwise specified, the below terms used herein are defined as follows:

I. Definitions

As used herein, the term "a," "an," "the" and similar terms used in the context of the present invention (especially in the context of the claims) are to be construed to cover both the singular and plural unless otherwise indicated herein or clearly contradicted by the context.

The term "button" is art-recognized as an electronic component that actuates a feature by positioning in an on or off position, e.g., actuates a light. The term button is intended to include all equivalents of buttons, including, for example, a trigger, a switch, a lever, or a knob.

The term "forend" is used herein to describe the component of the sliding sound assembly of a non-propellant personal defense tool of the invention that is operated by the user of the tool to create the defined sound by bidirectionally sliding over a defined segment of the combat housing. The forend derives its name from its equivalent look/feel to the part of a shotgun that is underneath the barrel used to cock the shotgun.

The language "non-lethal" is art-recognized, and is used herein to refer to weapons that are less-than-lethal weapons, non-deadly weapons, compliance weapons, or pain-inducing weapons, which are intended to be less likely to kill a living target than propellant-based projectile weapons such as a pistol or shotgun. Although it is understood that unintended or incidental casualties are possible whenever force is applied, the purpose of non-lethal weapons is to attempt to minimize the risk as much as possible.

The language "non-propellant" is used herein to describe personal defense tools that do not operate based on the use of a propellant to launch/fire a projectile. In this way, with respect to the non-propellant personal defense tools of the present invention, the combat housing is not capable of launching/firing a projectile using a propellant, e.g., an expanding gas created by ignition (e.g., smokeless powder or black powder) or by source cartridge (e.g., $CO_2$), i.e., the PDTs of the present invention are not capable of acting as a gun. These are in contrast to propellant-based projectile weapon which are weapons that fire ammunition comprising a projectile using expanding gases created by the ignition of a propellant or by source cartridge.

The term "operationally associated" is used herein to describe items that are associated, connected, or related in such a manner as to achieve a common intended purpose of operation of the items together. For example, a sliding forend may be operationally associated with the combat housing such that the two components are connected in such a way as to afford the ability of the sliding forend to bidirectionally slide across a segment of the combat housing.

The term "substantially" is used herein in reference to the degree or extent of the term which it modifies, and that such extent is near but not exactly 100%, and industry accepted standards will assist in defining the quantitative aspects of how "near" 100% is defined. For example, as used in the term "substantially cylindrical combat housing," the term "substantially" would indicate that the shape of the combat housing does not have to be exactly cylindrical, but is at least mostly cylindrical. Such combat housings would include a range of cylindrical shapes, including those that are perfectly cylindrical to those that would include a cylindrical shape that comprises a taper (i.e., referred to herein as tapered), such as a bat or a club The term "tapered" is art-recognized to describe the characteristic of shape to diminish or reduce thickness toward one end. In this way, the personal defense tools of the present invention that are substantially cylindrical, and comprise a tapered handle portion, afford a thinner handle portion and fatter upper portion. The position on the combat housing that is tapering is considered the "neck" of the combat housing.

II. Non-Propellant Personal Defense Tools (PDT) of the Invention

As such, in one embodiment, the present invention provides a non-propellant personal defense tool (PDT) comprising a combat housing, e.g., substantially cylindrical combat housing, acting as a scaffold for

- a sliding sound assembly comprising a sliding forend operationally associated with said combat housing to bidirectionally slide over a defined segment of the combat housing, wherein the act of sliding the forend in each direction along the sliding segment creates a defined sound;
- a battery assembly comprising a battery; and
- a vision impairment light operationally associated with the battery.

In a particular embodiment, the present invention provides a non-propellant personal defense tool (PDT) comprising a combat housing selected from an aluminum bat acting as a scaffold for

- a sliding sound assembly comprising a sliding forend operationally associated with said combat housing to bidirectionally slide over a defined segment of the combat housing, wherein the act of sliding the forend in each direction along the sliding segment creates a defined sound, wherein the defined sound is a mechanically generated sound that is the cocking sound of a forend of a shotgun;

a battery assembly comprising a lithium ion battery, further comprising a charging port, e.g., a USB charging port or 24V charging port; and an LED vision impairment light of greater than 1,000 lumens (e.g., greater than 1,500 lumens, e.g., greater than 2,000 lumens, e.g., about 3,000 lumens) operationally associated with the battery, e.g., positioned in the top end of the bat.

In another embodiment, the present invention provides a kit that is suitable for converting an aluminum bat into a non-propellant personal defense tool (PDT) of the present invention. For example, in one embodiment the non-propellant personal defense tool (PDT) comprises a combat housing acting as a scaffold for a sliding sound assembly comprising a sliding forend operationally associated with said combat housing to bidirectionally slide over a defined segment of the combat housing, wherein the act of sliding the forend in each direction along the sliding segment creates a defined sound;

a battery assembly comprising a battery; and a vision impairment light operationally associated with the battery.

A. Combat Housing

The non-propellant personal defense tools (PDT) of the present invention comprise a combat housing acting as a scaffold for the sliding sound assembly, battery assembly, and vision impairment light. The combat housing may vary in size and shape, provided it is capable of acting as a scaffold, and/or housing, for the sliding sound assembly, battery assembly, and vision impairment light. Moreover, the combat housing is the primary source of the mass and shape of the PDT affording the ability to inflict non-lethal injury upon a target by swinging. Representative examples of the combat housing include, but are not limited to, a club, a baseball bat, or a cricket bat.

In certain embodiments of the present invention, the combat housing is a substantially cylindrical combat housing. In certain embodiments, the substantially cylindrical combat housing comprises a tapered handle portion, e.g., comprising a grip on the handle portion. In particular embodiments, the substantially cylindrical combat housing is shaped like a baseball bat. In specific embodiments, the substantially cylindrical combat housing is an aluminum baseball bat housing.

In a particular embodiment of the present invention, the combat housing is an aluminum baseball bat with a diameter between about 2 and 3 inches, and a length of about 24 to 35 inches, e.g., 33 inches.

B. Sliding Sound Assembly

The non-propellant personal defense tools (PDT) of the present invention comprise a sliding sound assembly operationally associated with said combat housing. The sliding sound assembly comprises a sliding forend operationally associated with said combat housing to bidirectionally slide over a defined segment of the combat housing. Moreover, the act of sliding the forend in each direction along the sliding segment creates a defined sound.

In certain embodiments of the invention, the sliding forend is wrapped around the combat housing, e.g., completely or partially. In particular embodiments, the sliding forend is wrapped around the combat housing completely, e.g., completely encircling the combat housing.

The defined sound may be mechanically generated or electronically generated. In certain embodiments of the invention, the defined sound is electronically generated. In certain embodiments of the invention, the defined sound is mechanically generated. In particular embodiments, the sliding sound assembly produces a mechanically generated defined sound that utilizes a ball bearing, e.g., ball plunger (e.g., for additional clicking sound), which travels along a metal plate on the inside of the combat housing and the sound chamber to produce a loud sliding/scraping sound similar to the cocking sound of a forend of a rifle.

In certain embodiments of the invention, the defined sound is the cocking sound of a forend of a rifle, e.g., shotgun, e.g., a "tchk-tchk" of a cocking shotgun.

In certain embodiments of the invention, the sliding sound assembly comprises a sound chamber that affords sound amplification.

In certain embodiments of the invention, the combat housing further comprises slots positioned near the sliding forend, e.g., in the path of the sliding of the sliding forend, for sound amplification.

In certain embodiments of the invention, the sliding sound assembly comprises a sliding forend and a combat housing chassis assembly that links or associates the sliding forend to the combat housing. In certain embodiments, this combat housing chassis assembly is the structure that is capable of converting a standard aluminum bat to a non-propellant personal defense tool of the present invention, e.g., as part of a kit of the present invention.

C. Vision Impairment Light

The non-propellant personal defense tools (PDT) of the present invention comprise a vision impairment light. This light is designed to impair vision of an attacker, wherein vision impairment caused by the light affords the user the ability to mask the visualization of the device by the attacker.

In certain embodiments of the invention, the PDT further comprises a button, e.g., located on the handle, that is capable of activating the vision impairment light, e.g., when actuated/depressed.

In certain embodiments of the invention, the vision impairment light is operationally associated with the battery assembly, e.g., the battery.

In certain embodiments of the invention, the vision impairment light is greater than or equal to 80 lumens, e.g., greater than 300 lumens, e.g., greater than 500 lumens, e.g., greater than 1,000 lumens, e.g., greater than 1,500 lumens, e.g., greater than 2,000 lumens, e.g., about 3,000 lumens.

In certain embodiments of the invention, the vision impairment light is about 1000 lumens, e.g., one or more LEDs, e.g., standard Cree LEDs.

In certain embodiments of the invention, the vision impairment light is greater than about 1000 lumens, e.g., one or more LEDs, e.g., standard Cree LEDs. In a particular embodiments, the vision impairment light is a lens molding with three Cree LEDs producing around 1000 lumens of light. In specific embodiments, the inner aluminum combat housing is used as a cooling heat-sink.

In certain embodiments of the invention, the vision impairment light is positioned in the top end, e.g., end cap, of the combat housing, i.e., furthest from the handle. In certain embodiments of the invention, the vision impairment light is positioned in the top end cover of the combat housing, e.g., of an aluminum bat.

In certain embodiments of the invention, the vision impairment light is operationally associated with a timer.

D. Battery Assembly

The non-propellant personal defense tools (PDT) of the present invention comprise a battery assembly. The battery assembly comprises at least one battery. In certain embodiments, the battery assembly comprises more than one battery.

In certain embodiments of the invention, the battery assembly may further comprises a battery housing, e.g., which contains the one or more batteries in a suitable manner.

In certain embodiments of the invention, the battery is one or more lithium-ion battery cells, e.g., standard 18650 lithium-ion battery cell. In certain embodiments, the lithium-ion battery cell is located in the base of the combat housing, e.g., the pommel of the handle of a bat, e.g., completing the circuit.

In certain embodiments of the invention, the PDT further comprises a charging port operationally associated with the battery assembly to charge the battery, e.g., a standard micro USB port. In certain embodiments, the charging port is located in the base of the combat housing, e.g., the pommel of the handle of a bat.

In certain embodiments of the invention, comprises a battery status indicator.

E. Additional Components

Moreover, in certain embodiments, the PDTs of the present invention may incorporate additional design elements that do not significantly inhibit or prevent the features of the PDTs explicitly described herein. Such additional design elements may be the sole purpose of aesthetic design, e.g., an imprint, or for utility purposes, e.g., alarm or controller circuit. Certain additional components/elements may be designed to fit inside the body of the combat housing.

i. Alarm

In certain embodiments of the invention, further comprises an alarm button, e.g., a panic button system. In certain embodiments the alarm button is located on the middle of the combat housing, e.g., the neck of a bat. In particular embodiments, the alarm is activated by pressing two buttons simultaneously, e.g., the alarm button and the light button.

In certain embodiments of the invention, the alarm sound is generated within the combat housing, e.g., using the sound chamber.

In certain embodiments of the invention, the alarm sound is generated in a separate device using wireless communication, e.g., direct communication with a local device that produces the alarm sound, communication with an alarm service (e.g., which may activate an alarm), or communication with the police.

In certain embodiments, the alarm is operationally associated with battery assembly, e.g., the battery.

In certain embodiments, the alarm may be positioned externally, i.e., not directly connected with the controller circuit board.

ii. Controller Circuit

In certain embodiments of the invention, the PDT further comprises a controller circuit for controlling the operation of all electronic components powered by the battery. In particular embodiments, the controller circuit board holds the buttons and is located in the neck of the combat housing, e.g., bat, with buttons on the handle and neck.

III. Methods of the Invention

A. Methods of Manufacture

It should be readily understood by the ordinarily skilled artisan in light of the disclosure provided herein that a non-propellant personal defense tool constructed in accordance with the present invention can be manufactured in a variety of shapes and sizes. All structure components may be formed from metals such as aluminum, wood, resins or plastic materials such as polyethylene, polypropylene, polyvinyl chloride or polyethyleneterephthalat ("PETE"), as well as other suitable materials or combinations thereof. Moreover, the forming process can also vary to include methods such as thermoforming, injection molding or blow molding. In certain embodiments, the materials can be transparent, translucent, or opaque, and may be colored in any instance.

Moreover, in certain embodiments of the present invention, and by no means intended to limit the PDTs of the present invention in terms of design or construction, e.g., material composition, the combat housing is an aluminum baseball bat, and it should be understood that the construction of aluminum baseball bats is well known in the art. Such structure creates a hollow chamber for housing the controller circuit, battery assembly, and a top end that holds the vision impairment light.

IV. Design Aspects of the Invention

Independent of the utility related to the containers of the present invention, the ornamental appearance of any novel design provided herein is intended to be part of this invention, for example, each of the perspective views in FIGS. 1 through 9, which may form an independent or combined ornamental appearance of the non-propellant personal defense tools described herein.

Accordingly, one embodiment of the present invention provide an ornamental design for a non-propellant personal defense tools as shown and described.

Exemplification

Having thus described the invention in general terms, reference will now be made to the accompanying drawings of exemplary embodiments, which are not necessarily drawn to scale, and which are not intended to be limiting in any way.

In this respect, it is to be understood that the invention is not limited in its application to the details of construction and to the arrangements of the components set forth in the following description or illustrated in the Figures. The invention is capable of other embodiments and of being practiced and carried out in various ways. Also, it is to be understood that the phraseology and terminology employed herein are for the purpose of description and should not be regarded as limiting.

FIG. 1 is a side perspective view of a non-propellant personal defense tool (PDT) of certain embodiments of the present invention wherein the combat housing is an aluminum bat with additional components designed to fit inside the body, including LED light that fits in the front end and is activated by pressing button located on the handle, and a panic button system located on the neck of the bat. The sliding forend is positioned in the forward (or upward) direction as viewed from the handle, exposing the slots in the combat housing of the combat housing positioned near the sliding forend.

Figure 2:
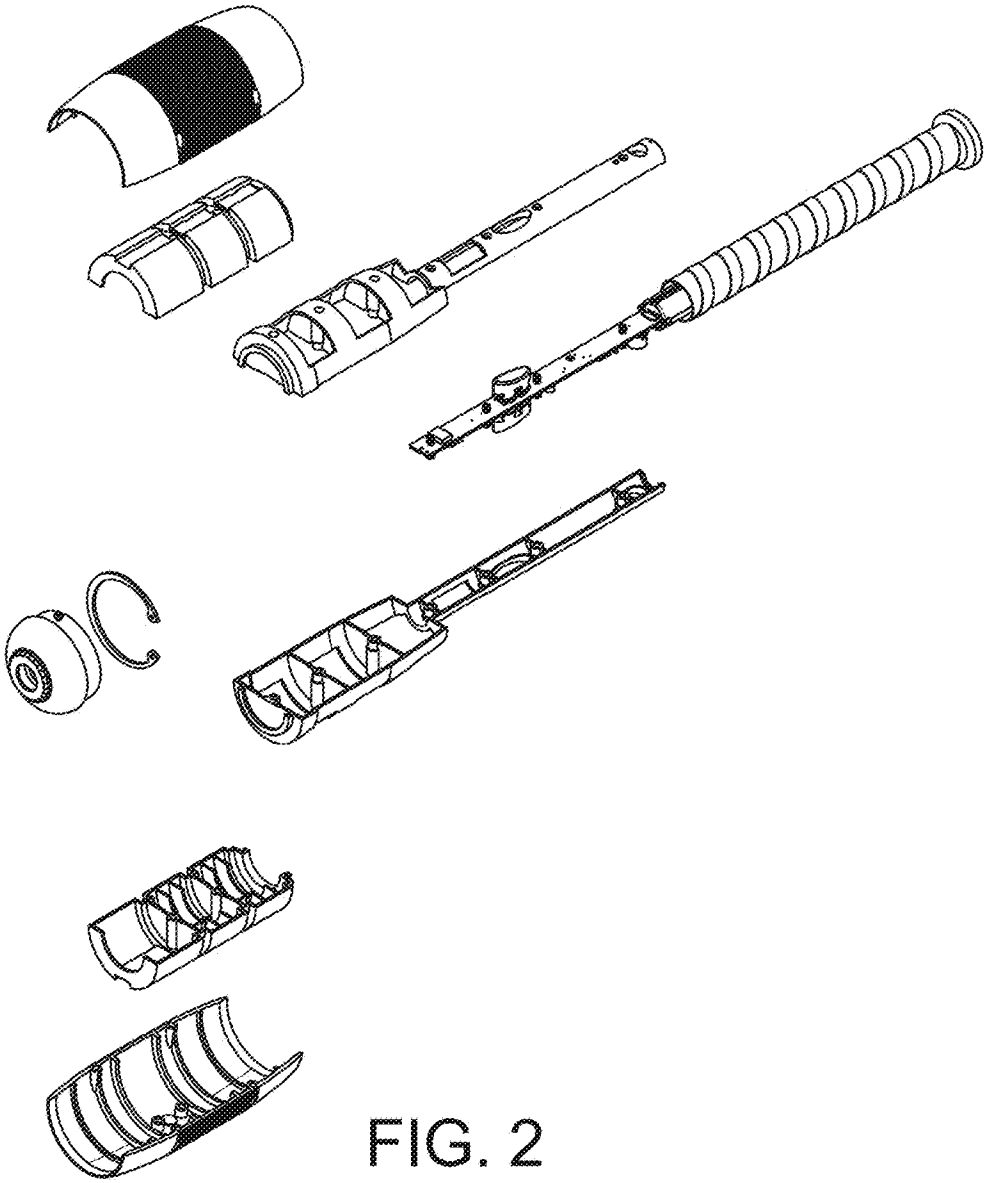
FIG. 2 is a side perspective view of a combat housing chassis assembly of certain embodiments of the present invention that are capable of converting a standard aluminum bat to a non-propellant personal defense tool of the present invention, with an LED vision impairment light in the front end cover.

FIG. 2 is a side perspective view of a combat housing chassis assembly of certain embodiments of the present invention that are capable of converting a standard aluminum bat to a non-propellant personal defense tool of the present invention, with an LED vision impairment light in the front end cover. The combat housing chassis assembly is depicted as its inner and out components relative to the combat housing itself. The upper and lower slide handle moldings are designed to wrap completely around the combat housing and link with the inner slide casings to form the complete sliding forend, and which are positioned internally based on the structure the inner chassis molding. The battery housing/enclosure is linked to the controller circuit and actuating buttons, and are designed fit within the handle and neck of a bat based combat housing.

Figure 3:
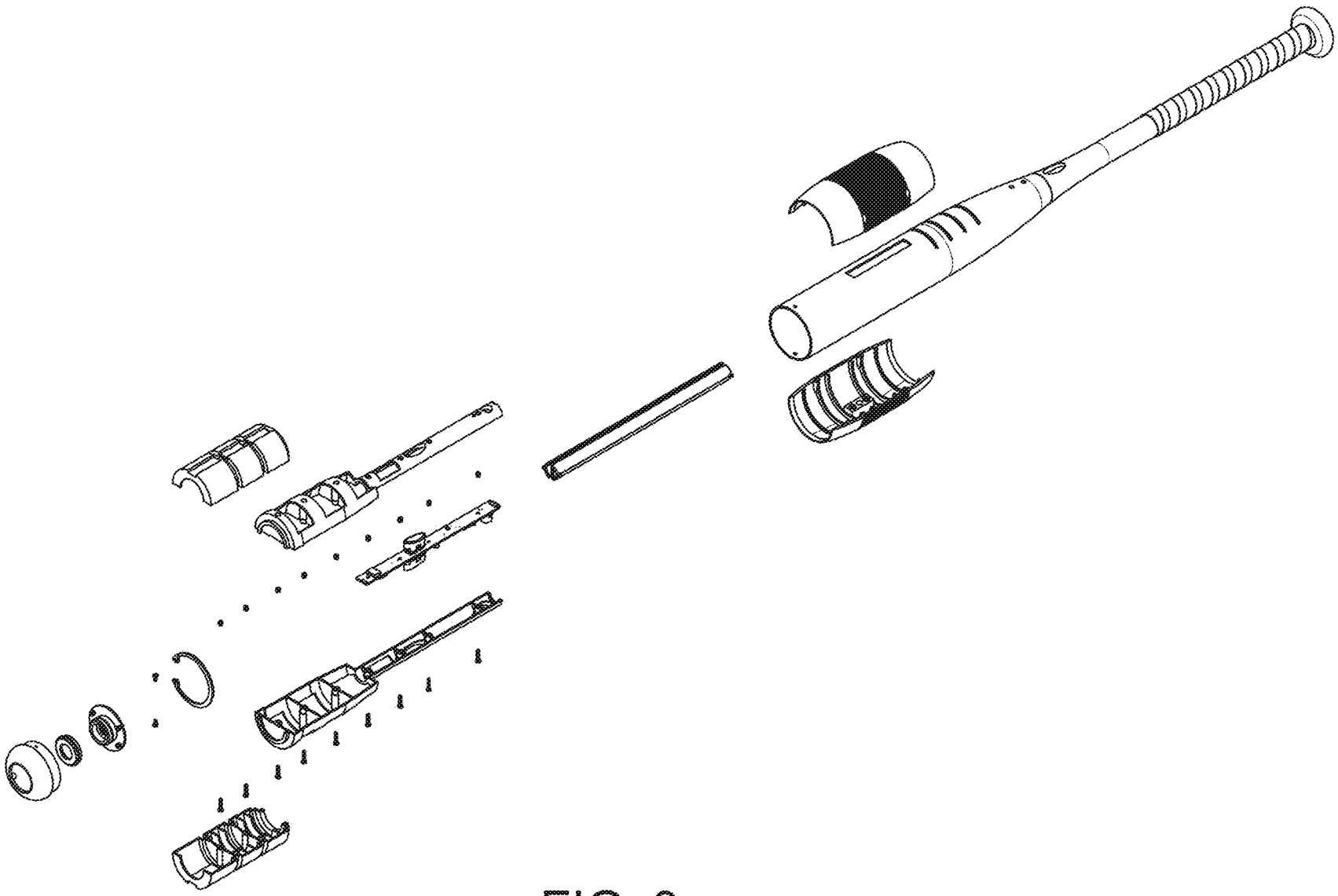
FIG. 3 is an exploded view of a non-propellant personal defense tool (PDT) of certain embodiments of the present invention with a standard bat positioned.
Figure 4A:
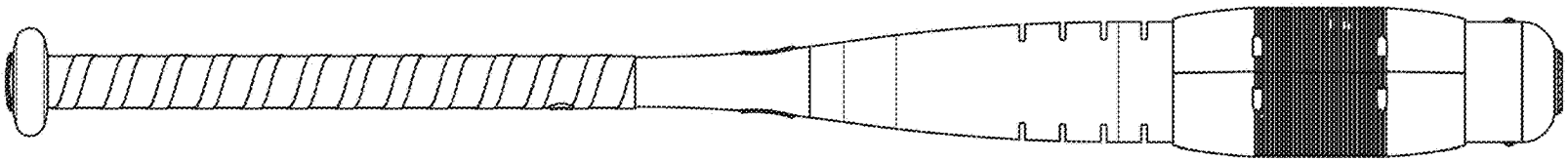
FIG. 4 is multiple schematic views of a non-propellant personal defense tool (PDT) of certain embodiments of the present invention depicting dimensions of all externally visible components.
Figure 4B:
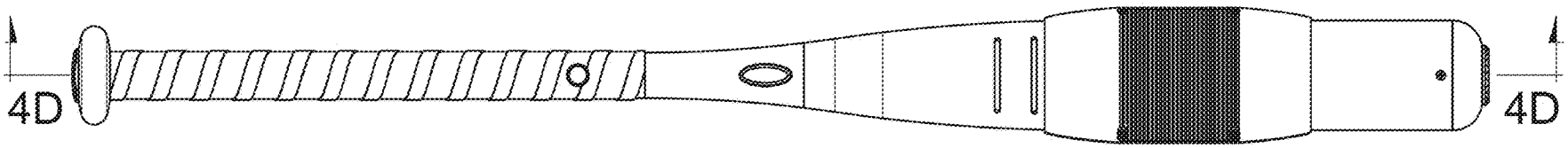
Figure 4C:
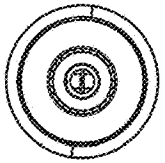
Figure 4D:
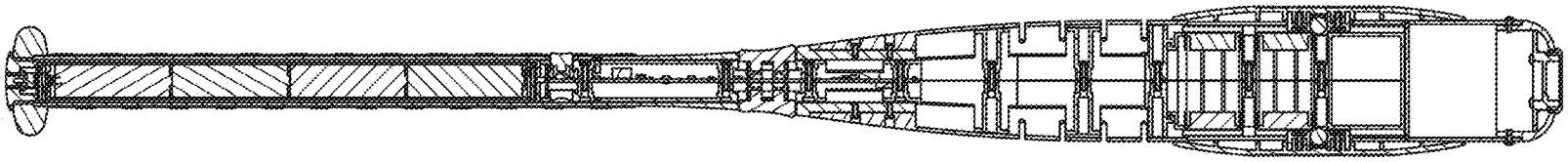

FIG. 3 is an exploded view of a non-propellant personal defense tool (PDT) of certain embodiments of the present invention with a standard bat positioned. The baseball bat 1 combat housing comprises a tapered body and an upper fatter portion and a lower handle portion with a rubber grip 2. The battery housing/enclosure 8 comprises series lithium ion battery 11 positioned in the handle. The inner chassis molding 3 is positioned inside the combat housing 1 to link the sliding forend to the combat housing 1. The sliding forend comprises the upper and lower slide handle moldings 30 that are designed to wrap completely around the combat housing and combine with the inner slide casings 6 to form the complete sliding forend, and which are positioned internally based on the structure the inner chassis molding 3. Controller circuit 4 contains vision impairment light button 7 and panic button 5. The crown cap 18 fits into the top cover of the baseball bat combat housing 1 and is fixed to star board mount plate 19, star LED 20, LED lens 27, and LED lens retainer 28. For a complete listing of part numbers see Table 1

TABLE 1

| ITEM NO. | PART NUMBER | QTY. |
|---|---|---|
| 1 | BASE BALL BAT-A00 | 1 |
| 2 | RUBBER GRIP-A00 | 1 |
| 3 | THE GUTS HOUSE-A00 | 2 |
| 4 | CIRCUIT CARD-A00 | 1 |
| 5 | PANIC BUTTON-A00 | 2 |
| 6 | UPPER & LOWER INNER BOOM HOUSE-A00 | 2 |
| 7 | FLASH LIGHT BUTTON-A00 | 1 |
| 8 | AA BATTERY CHASI-A00 | 1 |
| 9 | 5224-KEYSTONE COMPACT BATTERY CONTACT, POSITIVE, AA | 1 |
| 10 | BATTERY PACK CONTACT RING-A00 | 1 |
| 11 | 18650 SERIES LI-ION BATTERY | 4 |
| 12 | 92395A112 | 23 |
| 13 | 90272A111 | 7 |
| 14 | 90272A112 | 1 |
| 15 | 90272A117 | 4 |
| 16 | 90272A119 | 2 |
| 17 | 90272A115 | 1 |
| 18 | CROWN CAP-A00 | 1 |
| 19 | STAR BOARD MOUNT PLATE-A00 | 1 |
| 20 | 1W_star_LED | 1 |
| 21 | 2500-00551 | 3 |
| 22 | 2500-00551-BOTTOM-TRACE | 3 |
| 23 | 2500-00551-SOLDERMASK-BACK | 3 |
| 24 | 2500-00551-SOLDERMASK-BACK-N | 3 |
| 25 | 2500-00551-TOP-TRACE | 3 |
| 26 | 1_85_TRUNCATED_SOME | 3 |
| 27 | 10507-CARCLO 10.00 MM NARROW SPOT PLAIN TIR 3 UP LED LENSE | 1 |
| 28 | LENSE RETAINER-A00 | 1 |
| 29 | 90272A106 | 5 |
| 30 | UPPER & LOWER PUMP GRIP-A00 | 2 |
| 31 | UPPER & LOWER BOOM HOUSE-A00 | 2 |
| 32 | 9291K51-BEARING BALL | 2 |
| 33 | 1561T130-HIGH-LOAD COMPRESSION SPRING, 101 LBS PER IN, 7 LBS MAX | 2 |
| 34 | 90272A107 | 4 |
| 35 | END CAP-A00 | 1 |
| 36 | AA BATTERY SPRING MOUNT PLATE-A00 | 1 |
| 37 | PN211-KEYSTONE AA BATTERY SPRING, RIVET MOUNT | 1 |
| 38 | 97519A003-0.09375 IN. RIVET | 1 |
| 39 | USB-PCB | 1 |
| 40 | 614105150721 | 1 |

TABLE 1-continued

| ITEM NO. | PART NUMBER | QTY. |
|---|---|---|
| 41 | 614105150721_2 | 1 |
| 42 | 614105150721_Pin | 3 |
| 43 | 614105150721_PinBis | 2 |
| 44 | 99142A610 | 1 |
| 45 | 90380A106 | 1 |

FIG. 4 is multiple schematic views of a non-propellant personal defense tool (PDT) of certain embodiments of the present invention depicting dimensions of all externally visible components, including overall length, radius, handle length, and sliding forend length and diameter, as well as internal schematic structure.

Figure 5:
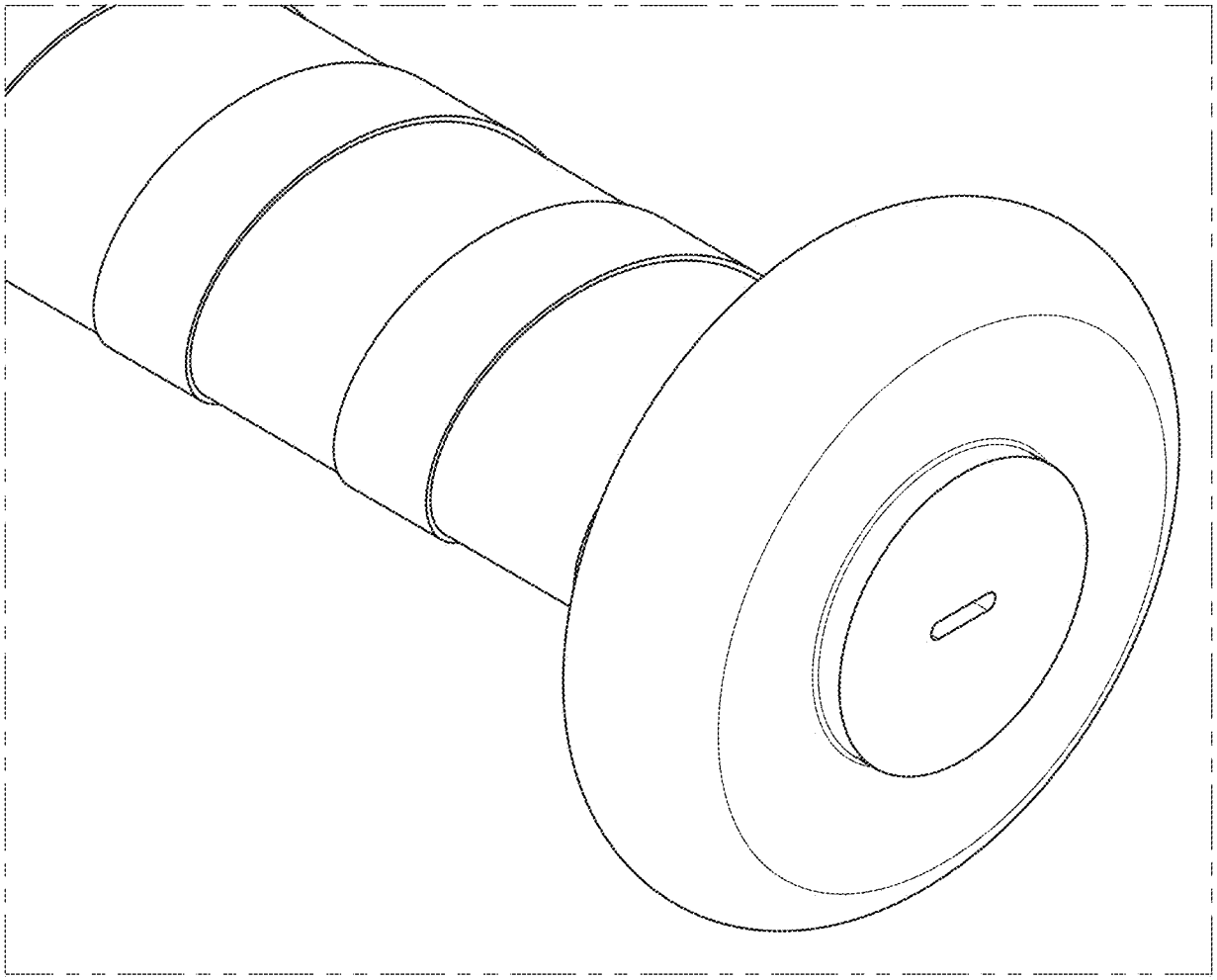
FIG. 5 is a perspective view of the end of the handle of certain embodiments of the present invention wherein the combat housing comprises an aluminum bat, wherein the end comprises a USB port, e.g., standard micro, located in the pommel of the handle useful for charging the battery.

FIG. 5 is a perspective view of the end of the handle of certain embodiments of the present invention wherein the combat housing comprises an aluminum bat, wherein the end comprises a standard micro USB port located in the pommel of the handle useful for charging the battery.

Figure 6:
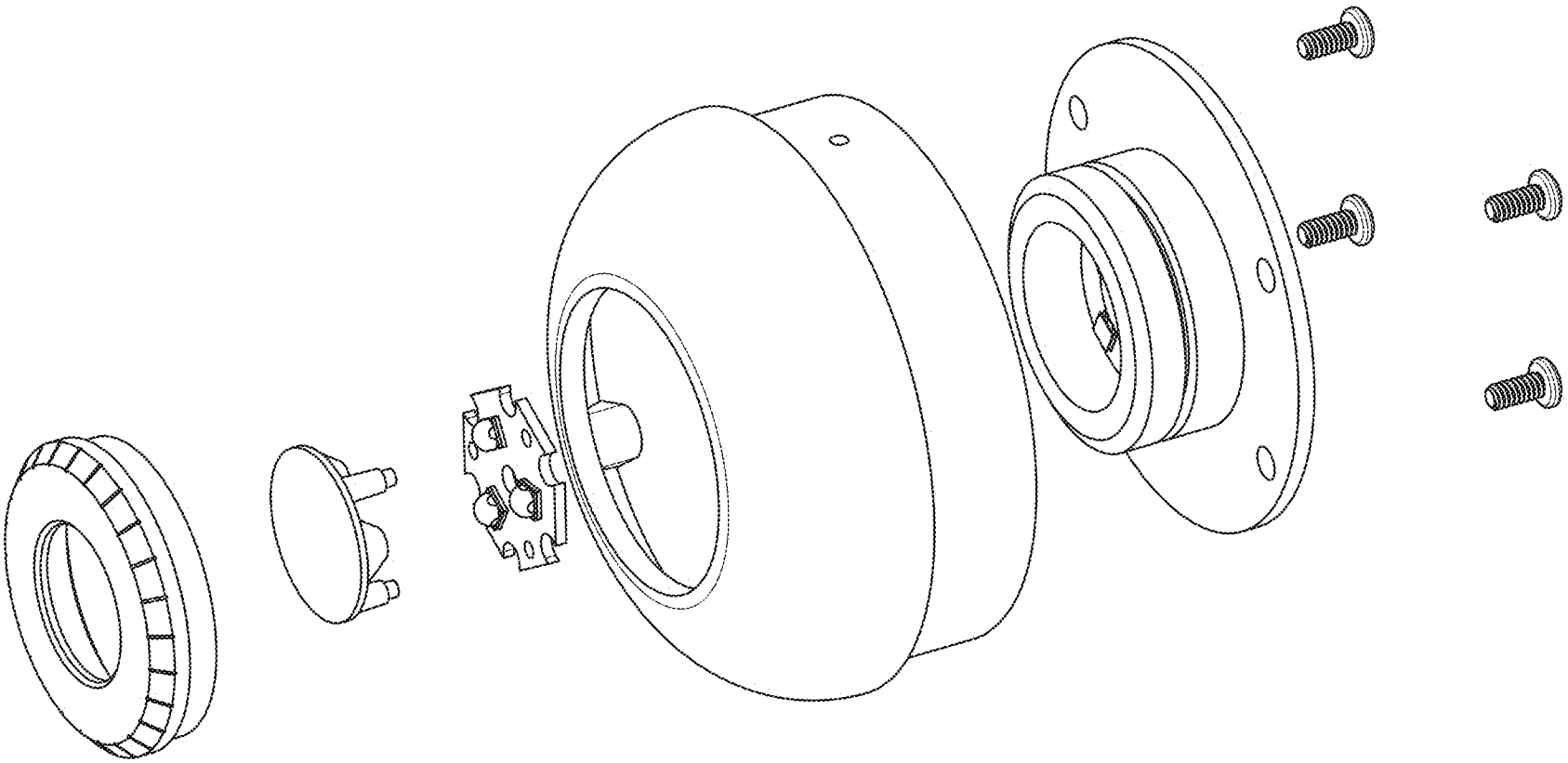
FIG. 6 is an exploded view of the vision impairment light assembly shown in FIG. 3.

FIG. 6 is an exploded view of the vision impairment light assembly shown in FIG. 3. The LED vision impairment light depicts the use of a standard Cree LED and lens molding with three Cree LEDs producing around 3000 lumens of light. The inner aluminum housing is used as a cooling heat-sink.

Figure 7:
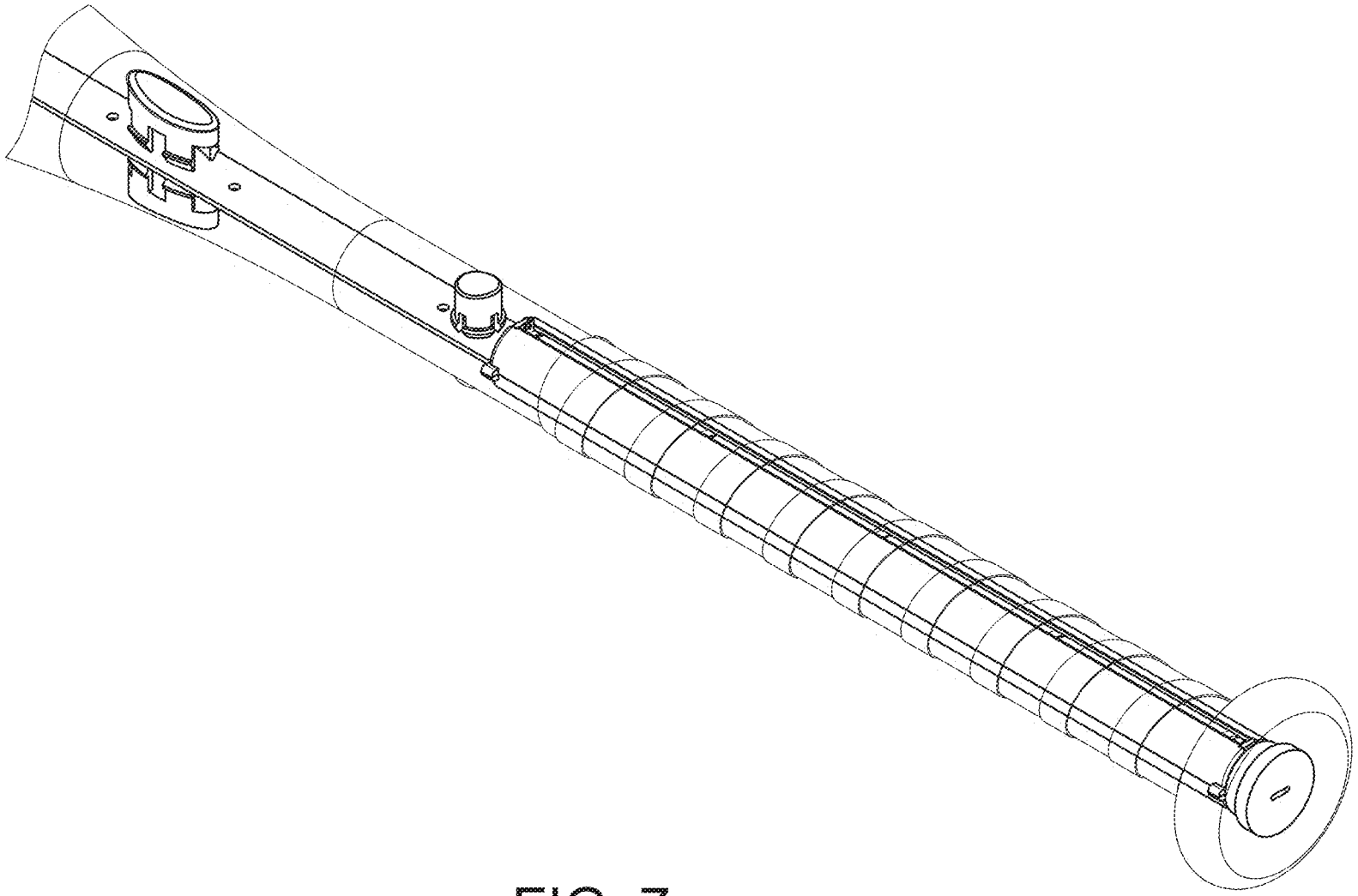
FIG. 7 is a side perspective X-ray view of the handle of a certain embodiment of the combat housing shown as a bat, depicting battery cells located in the handle with the end cap in the pommel completing the circuit, wherein the controller circuit board holds the buttons and is located in the neck of the bat with buttons on the handle and neck.

FIG. 7 is a side perspective X-ray view of the handle of a certain embodiment of the combat housing shown as a bat, depicting battery cells located in the handle with the end cap in the pommel completing the circuit, wherein the controller circuit board holds the buttons and is located in the neck of the bat with buttons on the handle and neck. The button on the handle actuates the vision impairment light, and the button on the neck of the combat housing triggers an alarm, e.g., when pressed along with the button for the vision impairment light.

Figure 8A:
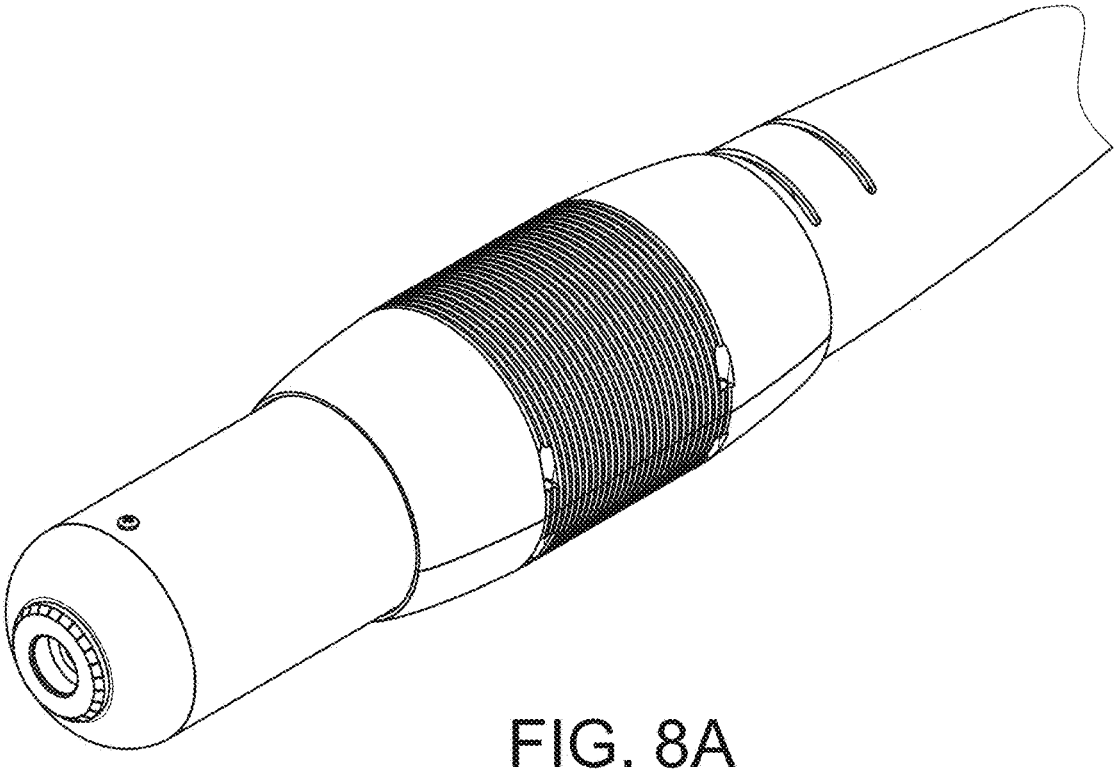
FIG. 8A is a side perspective external view of the sliding sound assembly of certain embodiments of the invention, wherein the sliding forend is wrapped around the combat housing completely.
Figure 8B:
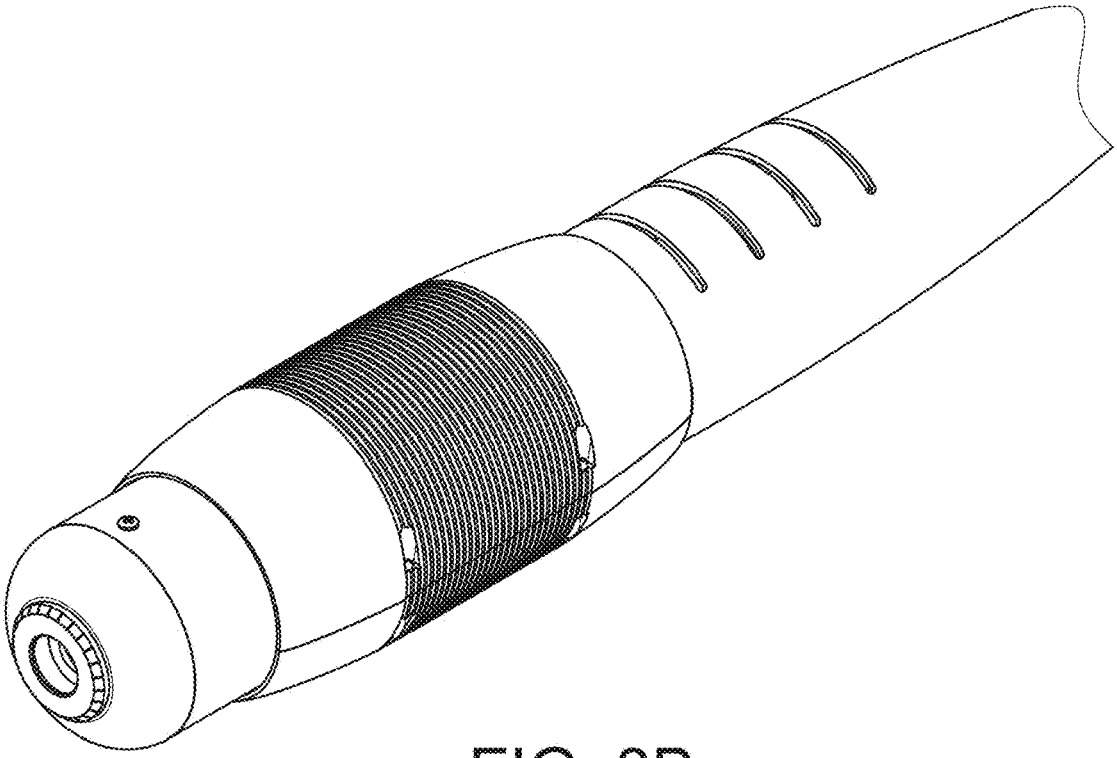
FIG. 8B is a side perspective external view of the same sliding sound assembly forend depicting the forward position of the slider and revealing the slots positioned in the path of the sliding of the sliding forend, e.g., for sound amplification.

FIG. 8A is a closer side perspective external view of the sliding sound assembly of certain embodiments of the invention, wherein the sliding forend is wrapped around the combat housing completely and the sliding forend is positioned in the rearward (or downward) direction as viewed from the handle, covering the slots in the combat housing. FIG. 8B is the side perspective external view of the same sliding sound assembly forend depicting the forward position of the slider and revealing the slots positioned in the path of the sliding of the sliding forend, e.g., for sound amplification. The circular sliding action handle affords easy access to the mechanism of the forend, as well as provides increased structure strength.

Figure 9:
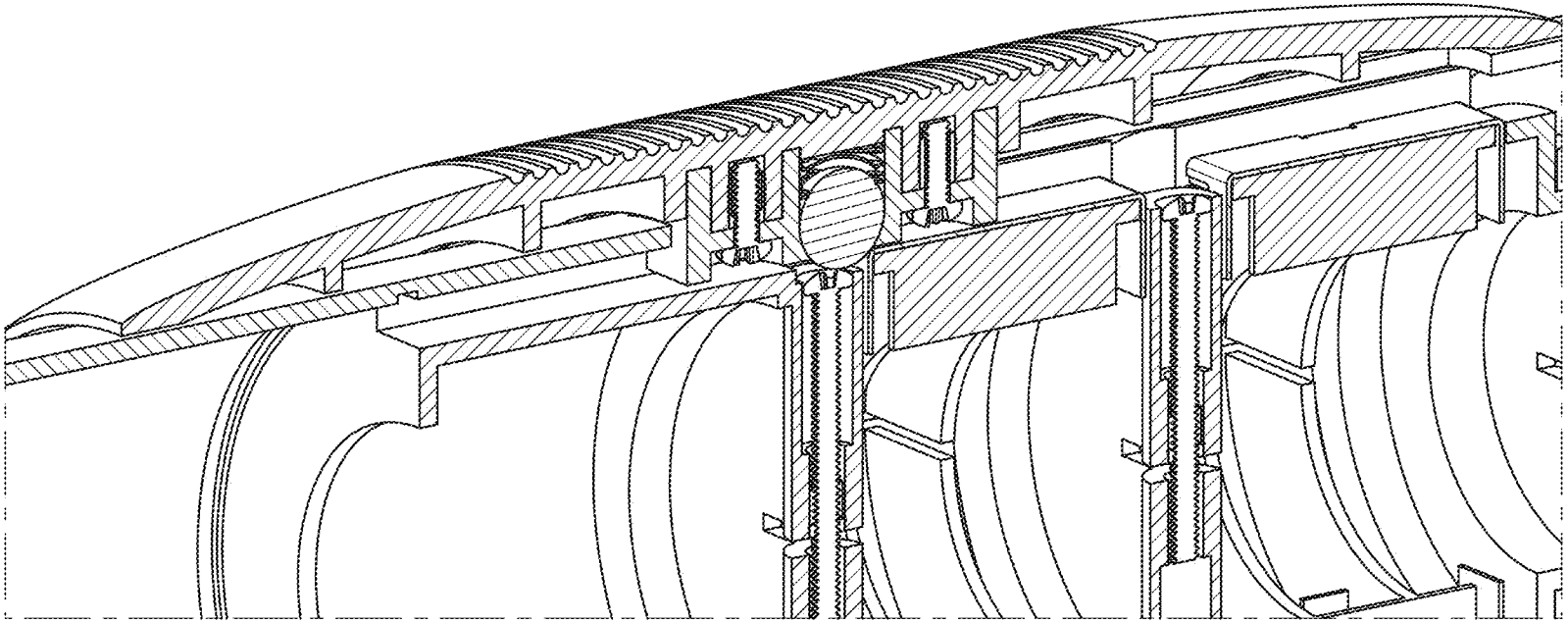
FIG. 9 is a cutaway view of the internal mechanism of a certain embodiment of the sliding sound assembly, which relies on a ball bearing that travels along a metal plate on the inside of the bat and a sound chamber to produce a loud sliding/scraping sound similar to a rifle being loaded.

FIG. 9 is a cutaway view of the internal mechanism of a certain embodiment of the sliding sound assembly, where a loud sliding/scraping sound similar to a rifle being loaded is produced as a ball bearing travels along a metal plate on the inside of the bat and a sound chamber to produce a loud sliding/scraping sound similar to a rifle being loaded. The sliding sound assembly comprises an inner and outer combat housing chassis assembly, operationally associating/linking the aluminum bat combat housing in between the inner and outer components of the chassis.

INCORPORATION BY REFERENCE

The entire contents of all patents, published patent applications and other references cited herein are hereby expressly incorporated herein in their entireties by reference.

EQUIVALENTS

Those skilled in the art will recognize, or be able to ascertain using no more than routine experimentation, numerous equivalents to the specific procedures described herein. Such equivalents are considered to be within the scope of this invention and are covered by the following claims. Moreover, any numerical or alphabetical ranges provided herein are intended to include both the upper and lower value of those ranges, unless clearly contradicted explicitly or by the context. In addition, any listing or grouping is intended, at least in one embodiment, to represent a shorthand or convenient manner of listing independent embodiments; as such, each member of the list should be considered a separate embodiment.

What is claimed is:

1. A non-propellant personal defense tool (PDT) comprising a combat housing acting as a scaffold for a sliding sound assembly comprising a sliding forend operationally associated with said combat housing to bidirectionally slide over a defined segment of the combat housing, wherein the act of sliding the forend in each direction along the sliding segment creates a defined sound, wherein the defined sound is the cocking sound of a forend of a rifle;

a battery assembly comprising a battery; and a vision impairment light operationally associated with the battery.

2. The non-propellant personal defense tool (PDT) of claim 1, wherein the combat housing is a substantially cylindrical combat housing.

3. The non-propellant personal defense tool (PDT) of claim 2, wherein the substantially cylindrical combat housing comprises a tapered handle portion.

4. The non-propellant personal defense tool (PDT) of claim 2, wherein the substantially cylindrical combat housing is shaped like a baseball bat.

5. The non-propellant personal defense tool (PDT) of claim 2, wherein the substantially cylindrical combat housing is an aluminum baseball bat housing.

6. The non-propellant personal defense tool (PDT) of claim 1, wherein the sliding forend is wrapped around the combat housing.

7. The non-propellant personal defense tool (PDT) of claim 6, wherein the sliding forend is wrapped around the combat housing completely.

8. The non-propellant personal defense tool (PDT) of claim 1, wherein the defined sound is mechanically generated.

9. The non-propellant personal defense tool (PDT) of claim 1, wherein the sliding sound assembly comprises a sound chamber that affords sound amplification.

10. The non-propellant personal defense tool (PDT) of claim 9, wherein the sliding sound assembly produces a mechanically generated sound that utilizes a ball bearing which travels along a metal plate on the inside of the combat housing and the sound chamber to produce a loud sliding/scraping sound similar to the cocking sound of a forend of a rifle.

11. The non-propellant personal defense tool (PDT) of claim 1, wherein the combat housing further comprises slots positioned near the sliding forend for sound amplification.

12. The non-propellant personal defense tool (PDT) of claim 1, wherein the vision impairment light is greater than or equal to 80 lumens.

13. The non-propellant personal defense tool (PDT) of claim 1, wherein the vision impairment light is about 1,000 lumens.

14. The non-propellant personal defense tool (PDT) of claim 1, wherein the vision impairment light fits in the top end of the combat housing.

15. The non-propellant personal defense tool (PDT) of claim 1, further comprising a button that is capable of activating the vision impairment light.

16. The non-propellant personal defense tool (PDT) of claim 1, wherein the vision impairment light is operationally associated with a timer.

17. The non-propellant personal defense tool (PDT) of claim 1, further comprising an alarm button.

18. The non-propellant personal defense tool (PDT) of claim 17, wherein the alarm sound is generated within the combat housing.

19. The non-propellant personal defense tool (PDT) of claim 17, wherein the alarm sound is generated in a separate device using wireless communication.

20. The non-propellant personal defense tool (PDT) of claim 1, wherein the battery assembly may further comprises a battery housing.

21. The non-propellant personal defense tool (PDT) of claim 1, wherein the battery is one or more lithium-ion battery cells.

22. The non-propellant personal defense tool (PDT) of claim 1, further comprising a charging port operationally associated with the battery assembly to charge the battery.

23. The non-propellant personal defense tool (PDT) of claim 1, further comprising a battery status indicator.

24. The non-propellant personal defense tool (PDT) of claim 1, further comprising a controller circuit for controlling the operation of all electronic components powered by the battery.

* * * * *